US007207962B2

(12) United States Patent
Anand et al.

(10) Patent No.: US 7,207,962 B2
(45) Date of Patent: Apr. 24, 2007

(54) STRETCH FABRIC SUBSTRATE FOR MEDICAL USE

(75) Inventors: Subhash Anand, Lancashire (GB); Subbiyan Rajendran, Lancashire (GB); Hiroaki Nakamura, Funabashi (JP); Takanobu Aoyagi, Yokohama (JP); Masatoshi Igarashi, Chiba (JP)

(73) Assignee: ALCARE Co., Ltd., Tokyo (JP)

( * ) Notice: Subject to any disclaimer, the term of this patent is extended or adjusted under 35 U.S.C. 154(b) by 0 days.

(21) Appl. No.: 10/521,092

(22) PCT Filed: Jul. 15, 2003

(86) PCT No.: PCT/GB03/03072

§ 371 (c)(1),
(2), (4) Date: Oct. 28, 2005

(87) PCT Pub. No.: WO2004/007822

PCT Pub. Date: Jan. 22, 2004

(65) Prior Publication Data

US 2006/0116044 A1 Jun. 1, 2006

(30) Foreign Application Priority Data

Jul. 16, 2002 (GB) ..... 0216519.9

(51) Int. Cl.
*A61F 13/00* (2006.01)

(52) U.S. Cl. ..... 602/8; 602/6; 602/75; 602/76

(58) Field of Classification Search ..... 602/6, 602/8, 75, 76

See application file for complete search history.

(56) References Cited

U.S. PATENT DOCUMENTS 3,965,703 A 6/1976 Barnhardt
4,244,171 A 1/1981 Sasaki et al.

FOREIGN PATENT DOCUMENTS

GB 2 089 850 A 6/1982
GB 2 223 513 A 4/1990

*Primary Examiner*—Kim M. Lewis
(74) *Attorney, Agent, or Firm*—Harness, Dickey & Pierce, P.L.C.

(57) ABSTRACT

The present invention provides a stretch fabric substrate for medical use in a simple knitted structure with a good productivity having such a desired elastic recovery of elongation that no reduction of the fabric substrate in the widthwise direction takes place when elongation is applied to a necessary extent in the lengthwise direction. The fabric substrate according to the present invention is constituted by means of a warp knit substrate, the warp knit substrate is formed by means of a chain stitch using a stretch multifilament textured yarn and elastic yarns and non-stretch yarns are inserted in the lengthwise direct ion and in the widthwise direction, respectively to the chain stitch.

13 Claims, 2 Drawing Sheets

STRETCH FABRIC SUBSTRATE FOR MEDICAL USE

CROSS-REFERENCE TO RELATED APPLICATIONS

This application is a National Stage of International Application No. PCT/GB03/03072. filed 15 Jul. 2003, published in English as WO 2004/007822 on 22 Jan. 2004, which claims the benefit of Great Britain application number 0216519.9, filed 16 Jul. 2002. The disclosures of the above applications are incorporated herein by reference.

The present invention relates to a stretch fabric substrate which is used by attaching to diseased part in a medical field.

In surgical and orthopaedic fields, a therapy is carried out by fixation the diseased part of the patients having diseases such as bone fracture, dislocation, sprain and deformation and, for fixation the diseased part, it has been demonstrated that a tape-like fabric substrate coated with a polyurethane resin is applied to the diseased part and then the polyurethane resin is made to react with moisture to cure. It is necessary that this substrate for a water curable cast has an appropriate stretch and, although various fabric substrate structures have been proposed, there are fundamentally the following four types. The first one is a knitted structure using a non-stretch yarn such as polyester and glass fibre with an elastic yarn such as polyurethane (e.g., Japanese Patent Laid-Open No. 11165/1988); the second one is a structure using a stretch-textured yarn such as hard twist yarn and crimp-textured yarn (e.g., Japanese Patent Laid-Open No. 71746/1990); the third one is a structure where fabric substrate is subjected to an after-treatment such as thermal treatment and chemical treatment to give stretch (e.g., Japanese Patent Laid-Open No. 502528/1991); and the fourth one is a structure where stretch is given by a knitting texture (e.g., Japanese Patent Laid-Open No. 177655/1983).

In the first fabric substrate, stretch is given by elastic yarn and, since non-stretch yarn is used in warp knit, the maximum elongation is dependent upon the structure elongation of the chain structure in a simple knitting structure such as chain stitch. In order to solve that point, there are available a method where a special knitting method is used and a method where, in an elastic yarn, chain stitch is shortened in a continuous V-shape in the thickness direction of the fabric substrate so that elongation is given. However, the former method causes a cost increase while the latter method causes an increase in the thickness of the fabric substrate and an increase in instability of the property of the product. In the fabric structure of the second method, elongation is given to non-stretch yarn by giving a spring function by thermal treatment, etc. but, on the other hand, in order to give a desired elastic recovery of elongation, it is necessary to use a yarn having a good elastic recovery of elongation such as hard twist yarn and that causes a cost increase. In the third fabric substrate, deformation of heat shrinkable plastic is utilized to give the same physical property as the second fabric substrate has. However, that is basically to give an elastic recovery of elongation by shrunk filament or to give a wavy treatment to the fabric substrate itself and the former has a limit in the elastic recovery of elongation while the latter causes instability of physical property and cost increase. In the fourth fabric substrate structure, stretch is given by considering the knitted structure itself. Basically however, the elongation which is able to be given thereto is apt to be lacking and, in addition, the yarn used there has no elastic recovery of elongation, the knitted structure becomes complicated causing a cost increase for preparing a fabric substrate having a desired elastic recovery percentage of elongation. Thus, each of the fabric substrates of those structures has a problem and no fabric substrate which is satisfactory for medical use has been available yet.

Besides the water curable cast, there are often the necessities where stretch fabric substrate is applied for covering the diseased area in a medical field. For example, in the case of fixation of medical materials such as poultice or splint to human body for the therapy of diseased part such as sprain and varicose vein of lower extremity or prevention of external wound in sports, a stretch fabric substrate is used as a bandage for compression and fixation. Further, in the case of fixation of gauze or the like to human body for therapy of muscles and joints and for prevention of external wound in sports, an adhesive tape is used and, as a material for the adhesive tape, a stretch fabric substrate is necessary. Furthermore, with an object of therapy of external wound, stopping the pain, beauty, etc., a coating material for the therapy containing various effective ingredients is used. As a fabric substrate therefore, a stretch fabric substrate is used or, as a carrier for an adhesive layer or a gel substance containing the said effective ingredients, a stretch fabric substrate is necessary. Besides the above, a stretch fabric substrate is used as a mat for the prevention of decubitus and as a covering material for covering the surface of devices such as a supporter. With regard to fabric substrates which are used for those various medical materials, there are also the same problems as in the fabric substrate for the above-mentioned water curable cast and there is a brisk demand for a fabric substrate which is able to resolve them.

An object of the present invention is to provide a stretch fabric substrate for medical use in a simple knitted structure with a good productivity having such a desired elastic recovery of elongation that no reduction of the fabric substrate in the widthwise direction takes place when elongation is done in a necessary extent in the lengthwise direction and no loosening takes place after winding around the applied area and also having a structure causing no problem in the use of a water curable resin when used as a fabric substrate for a water curable casting tape.

In order to solve the above problems, the present invention is constituted by means of a warp knit substrate. The warp knit substrate is formed by means of a chain stitch using a stretch multifilament textured yarn and elastic yarns and non-stretch yarns are inserted in the lengthwise direction and in the widthwise direction, respectively to the chain stitch.

It is advantageous when the multifilament textured yarn is constituted in such a manner that plural stretched filaments are aligned and the filaments have connecting parts each other.

With regard to a material for the stretch multifilament textured yarn constituting the warp knit substrate, it is necessary that a treatment for giving a stretching property to each filament constituting the said yarn is easy, that a desired strength is achieved when used as a casting tape for an orthopaedic casting tape and that reactivity with water-curable resin is low. Thus, a filament derived from resin comprising a synthetic polymer is preferred and, for example, there may be used filament comprising high-molecular resin such as polyester resin, polyamide resin, polyolefin resin, polyacrylic resin and polyvinyl chloride resin or a compounded product thereof. Among them, polyester resin, polyamide resin and polyolefin resin are preferred and a stretch textured yarn constituted from filaments comprising a polyester resin is particularly preferred.

With regard to a method for a stretching treatment for a filament constituting the stretch textured yarn, the conventionally known methods such as a crimp treatment may be used and there may be exemplified a method where a physically fine waving treatment is applied such as heat texturing process such as false twist, knit-de-knit, edge crimping etc and stuffer box method; air-textured, a melt spinning method where, during the stage of formation of the fibre forming the filament, a polymer having a thermal shrinking property and a polymer having a non-thermal shrinking property or a low-thermal shrinking property are made into filament in a melted state; etc. It is also possible to constitute a stretch textured yarn using filaments to which stretch is given by twisting and, in that case, it is preferred to subject to a thermal treatment to fix the twist. With regard to a waving treatment to those filaments, any method will do so far as a necessary elongation percentage is achieved although, in view of simplicity of the treatment and also stability of the resulting wave, it is preferred to use heat texturing process such as false twist, knit-de-knit, edge crimping etc and air-textured, and melt spinning method are preferred.

With regard to each filament, there may be used a filament having an elongation upon application of a load to an approximate extent of preferably from 1.1- to 4.0-fold or, more preferably, from 1.5- to 2.5-fold which is caused not by the material of the filament but by the structure of the filament as compared with the length of the filament of an unloaded state. Elongation of the filament caused by the structure referred to hereinabove includes that which expresses the elongation caused by a physical shape of the filament such as crimp and twisting treatment. When the elongation is less than 1.1-fold, the product is hardly applicable to the surface of living body in case it is used as a warp to constitute chain stitch while, when it is more than 4.0-fold, pilling is formed on the surface of the wave, smoothness on the surface of the fabric substrate is lost or the fabric substrate itself is deformed in case it is used as a warp to constitute chain stitch whereby the product is not preferred as an aimed fabric substrate material.

When plural filaments to which stretch is given as above are aligned, a multifilament is constituted but, when it is used as a conventional multifilament, several problems occur. Firstly, when the filament subjected to a texturising treatment is processed by a knitting machine, each waved filament is rubbed by a guide bar or an inlay bar of the knitting machine whereby finely-split cut yarns are formed. Secondary, when a fabric substrate is manufactured using the multifilament subjected to a texturising treatment, pilling and pile caused by the wave are apt to be formed on the surface of the fabric substrate whereby smoothness of the surface of the fabric substrate is lost and the property which is not preferred as the aimed material is apt to be resulted. Therefore, in the present invention, each filament in the multifilament is connected each other with an interval in the lengthwise direction of the filament. As a result of a partial connection each other as such, permeation of the resin into the yarn composed of filament is good when used as a fabric substrate for a water curable casting tape whereby it is possible to achieve the characteristic of the multifilament in the physical strength after curing and it is also possible to prevent the breakage of yarn upon being processed by a knitting machine.

In connecting each of the filaments of the multifilament, there are many methods such as thermal bonding, bonding by ultrasonic wave, treatment by various adhesives, bonding by convergent laser beam and shrink treatment by heat shrinkable film, etc. Among those methods, preferred ones are thermal bonding, bonding by ultrasonic wave and bonding by convergent laser beam and particularly preferred one is bonding by convergent laser beam whereby filaments can be continuously and uniformly adhered each other by convergence of laser beam. With regard to laser beam source, there is no particular limitation so far as it is a beam source such as carbon dioxide gas laser and ruby laser being able to achieve the object.

With regard to the mode of connecting point of the filaments, it is not necessary that all filaments constituting the yarn are connected but it will do that at least 50% of the total filament numbers are connected at each connecting point. Incidentally, it is preferred when 70%~100% are connected and it is particularly preferred when 80%~100% are connected. It is also preferred that the filaments constituting the external circumference of the yarn are predominantly connected each other.

The connecting times of the filaments in the lengthwise direction at the area excluding the connected length of the connected area is from 0.3 time/cm to 10 times/cm, preferably from 0.5 time/cm to 5 times/cm and, more preferably, from 1 time/cm to 3 times/cm. It is not preferred that the connecting times are lower than 0.3 time/cm because of an increase in disadvantages such as that pilling is resulted in the fabric substrate as the final product, that smoothness is lost or that yarn breakage increases in a knitting machine. There is no particular limitation for the length of the connecting point so far as it has no influence on the knitting machine or on the adaptability of the fabric substrate as the final product to the surface of the living body although it is within an approximate range of, for example, from 1 mm to 20 mm, preferably from 2 mm to 15 mm or, more preferably, from 5 mm to 10 mm. It is not preferred when the length of the connecting point is long because the hardness of the connecting point affects the characteristics of the knitted goods or that causes breakage of the yarn in the knitting machine. When it is shorter than 1 mm, physical stability of the connecting part is apt to be hardly available or steps for the manufacturing of the yarn become complicated and that causes a cost increase. Although the interval between the connecting points is not particularly defined, it is preferred that the length of the connecting point and the length of the non-connecting point are regularly prepared.

It is preferred that the stretch textured yarn has an elongation upon loading within an approximate extent of from 1.1-fold to 2.0-fold, preferably from 1.15-fold to 1.5-fold or, more preferably, from 1.15-fold to 1.3-fold as compared with the length of the unloaded state which is not due to the material of the filament but due to the structure of the filament.

It is preferred that the elastic yarn which is inserted into the chain stitch in a lengthwise direction is aligned in parallel to the chain stitch. The reason is that the elastic yarn is to give an elastic recovery of elongation which is insufficient in the stretch textured yarn constituting the chain stitch to the fabric substrate and, therefore, it is preferred to align in parallel to the lengthwise direction of the fabric substrate.

Examples of the material for the elastic yarn are elastomers such as polyurethane, natural rubber, polyisoprene rubber, polybutadiene rubber, styrene-isoprene block copolymer and styrene-butadiene block copolymer. Among those, polyurethane is particularly preferred. A representative elastic yarn prepared from polyurethane is Lycra™ comprising segmented polyurethane.

Examples of the yarn constituting the elastic yarn are monofilament, multifilament and twisted yarn. Among those, monofilament and twisted yarn are preferred and monofilament is more preferred. With regard to the shape of the yarn, any of single covered yarn, core spun yarn, bare yarn, etc. may be used depending upon the object although bare yarn whereby elastic recovery of elongation which is an object of use of elastic yarn is optimumly achieved is preferred. The use of bare yarn is a means for the most effective use of the elastic recovery of elongation of the yarn but, in the preparation of the knitted structure, a high technique is necessary. In accordance with the present invention however, the simplest knitted structure among the knitted structures is used and, as a result, it is now possible to prepare a knitted structure without any particularly high technique even when a bare yarn is used whereby productivity is enhanced and cost is reduced.

With regard to an elongation percentage of the elastic yarn, the minimum elongation at break is at least 200%, preferably 250% or more and, more preferably, 300% or more.

With regard to material of the non-stretch yarn inserted in the widthwise, a material which is used for stretch textured yarn used for chain stitch may be used basically. For example, there may be used filament comprising high-molecular resin such as polyester resin, polyamide resin, polyolefin resin, polyacrylic resin and polyvinyl chloride resin or a compounded product thereof. Among them, polyester resin, polyamide resin and polyolefin resin are preferred and a non-stretch yarn constituted from a filament comprising a polyester resin is particularly preferred.

With regard to the form of the non-stretch yarn, there is no particular limitation and its examples are multifilament and twisted yarn. In the case of a fabric substrate for a water curable casting tape, multifilament is preferred because of a good permeability of the water curable resin to the yarn.

With regard to physical property of the non-stretch yarn, it is desired to have rigidity of some extent since it has an object of keeping the shape of the fabric substrate as weft. For such an object, its resistance of incipient tension (JIS L1013) is to be at least 2 N/tex, preferably 4 N/tex or more and, more preferably, 10 N/tex or more.

With regard to the way of knitting of the fabric substrate, a preferred one is a simple and highly-productive knitting structure where a chain stitch is constituted in the lengthwise direction of the fabric substrate while weft yarn linearly or obliquely in the widthwise direction of the fabric substrate to give a connection in the widthwise direction and there may be used Raschel knitting machine, Crochet knitting machine and Tricot knitting machine. Preferably, Raschel knitting machine and Crochet knitting machine may be used. When a narrow product is required, crochet machine is more productive and economical to use, especially when processing staple-fibre yarns, textured and other bulked yarns.

Physical properties of the fabric substrate are as follows. As to the elongation percentage of the fabric substrate in the lengthwise direction with the load of 9.81 N, it is preferably from 120% to 180%, more preferably from 130% to 160% and, most preferably, from 140% to 150%. Especially in the case of the fabric substrate for a water curable casting tape, the stretch which is inherent to the fabric substrate is somewhat inhibited because a highly viscous resin is impregnated in or coated on the fabric substrate and, therefore, the elongation percentage of the fabric substrate impregnated or coated with the water curable resin in the lengthwise direction with the load of 9.81 N is preferably from 110% to 180%, more preferably from 120% to 160% and, most preferably, from 130% to 150%. When it is less than 110%, conformability is difficult depending upon the shape of the applied site while, when it is more than 180%, it is difficult to adjust the elongation percentage for achieving an appropriate pressure when applied whereby an operator feels the difficulty in winding and that is not preferred. Thickness of the fabric substrate is within a range of from 0.5 mm to 2.0 mm, preferably from 0.8 mm to 1.5 mm and, more preferably, it is about 1.0 mm. Approximate mass by unit area of the fabric substrate is within a range of from 100 $g/m^2$ to 240 $g/m^2$, preferably from 140 $g/m^2$ to 200 $g/m^2$ and, more preferably, from 170 $g/m^2$ to 180 $g/m^2$. Gauge of the knitting machine is from E 6 to E 12, preferably from E 7.5 to E 10.5 and, more preferably, E 8 to E 9 (E=needles/inch).

When used as a water curable casting tape, the water curable resin which is impregnated in or coated on the fabric substrate may be the same as that used for the conventional water curable cast (refer, for example, to Japanese Patent Laid-Open Nos. 41116/1991, 263865/1992, 163649/1995, etc.) and a water curable urethane prepolymer is suitable for example. This is a prepolymer having an isocyanate group at the terminal obtained by the reaction of polyol with polyisocyanate and, when water is supplied in use, the reaction occurs giving a urethane bond whereupon curing takes place to form polyurethane. With regard to the polyol, there may be used polyethylene glycol, polypropylene glycol, a copolymer of ethylene glycol with propylene glycol, etc. In the water curable resin, there maybe used catalyst, stabiliser, defoaming agent, antioxidant, colouring agent, thixotropic agent, bulking agent, etc. so as to adjust curing time, stability upon preservation, promotion of defoaming in curing, final colour tone, etc. Conventionally used ones may be used for those additives as well.

Figure 1:
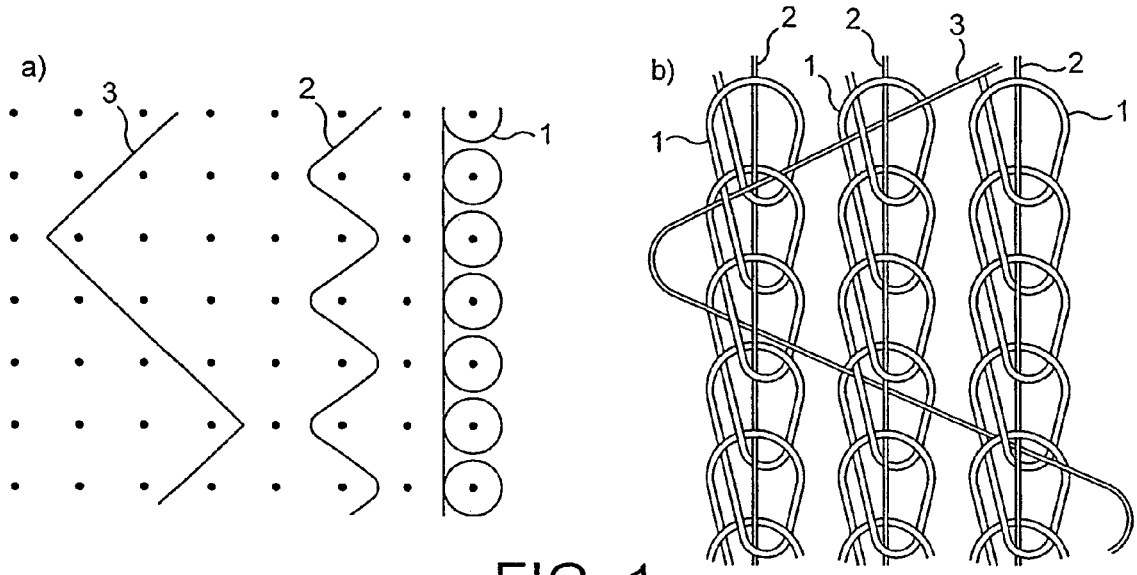
FIG. 1 is an example of the fabric substrate of the present invention where "a" is the lapping movements and "b" is a drawing of the structure of knitted fabric.
Figure 2:
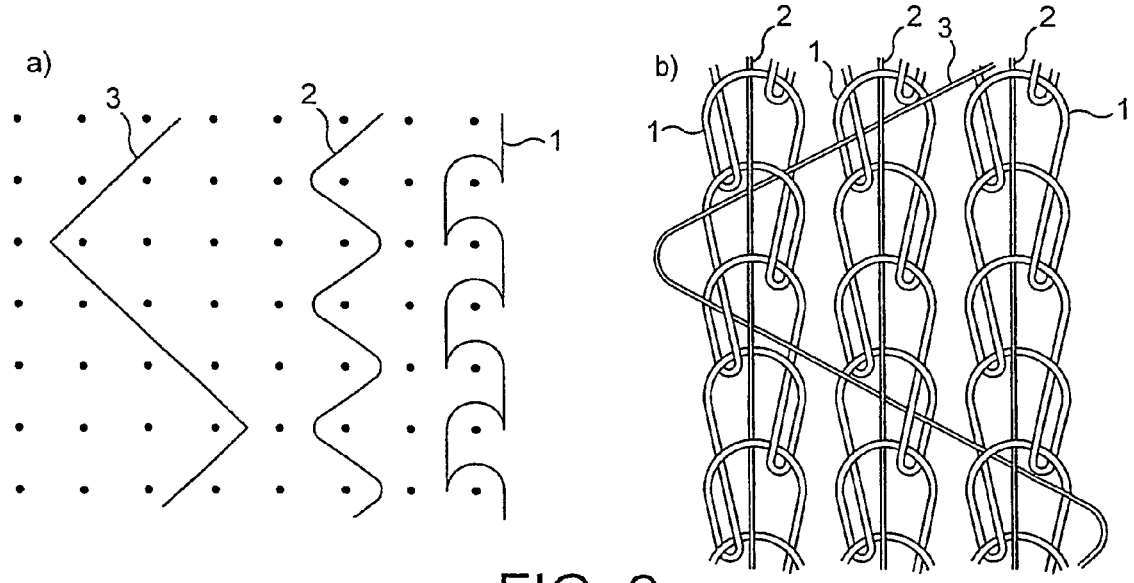
FIG. 2 is another example of the fabric substrate of the present invention where "a" is the lapping movements and "b" is a drawing of the structure of knitted fabric.
Figure 3:
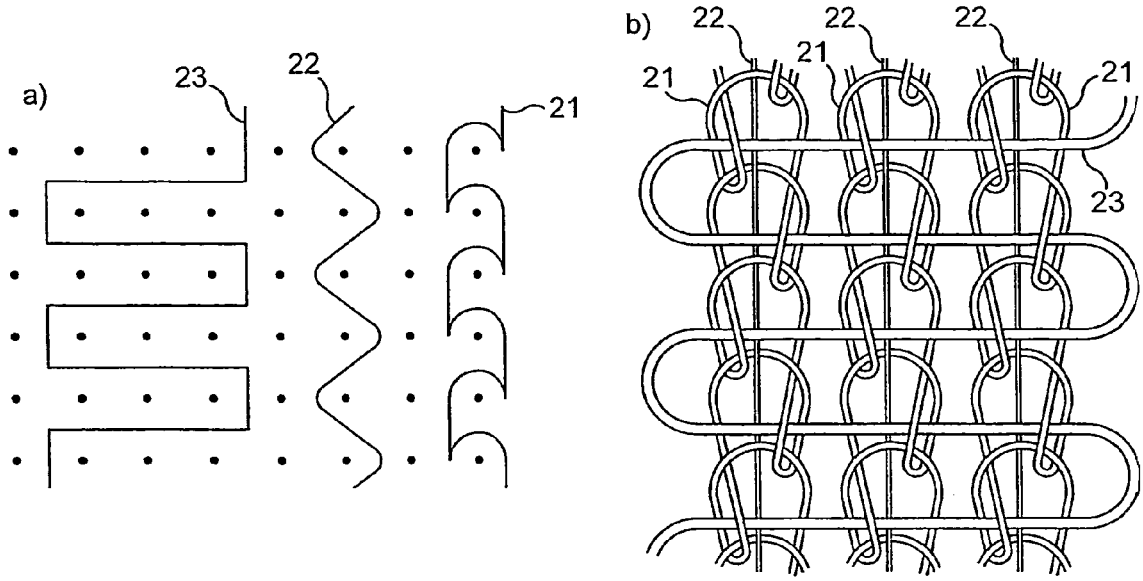
FIG. 3 is further another example of the fabric substrate of the present invention where "a" is the lapping movements and "b" is a drawing of the structure of knitted fabric.
Figure 4:
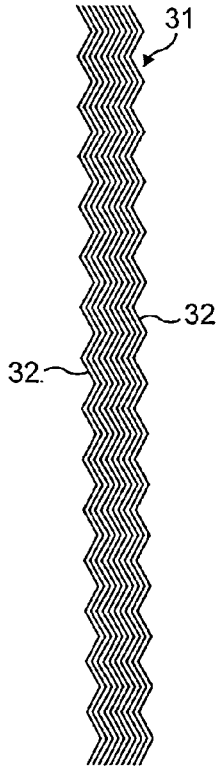
FIG. 4 is an example of the multifilament textured yarn used in the present invention.
Figure 5:
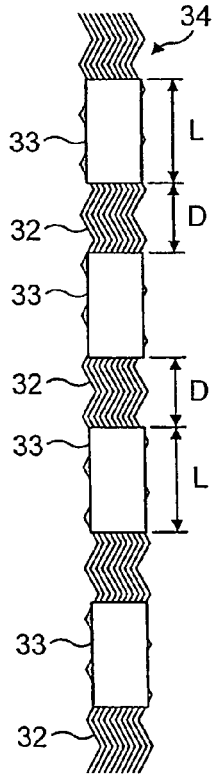
FIG. 5 is another example of the multifilament textured yarn used in the present invention.

In FIG. 1, "a" shows the lapping movements of the fabric substrate of the present invention and "b" shows a drawing of the structure of the knitted fabric thereof in which 1 is a stretch multifilament textured yarn forming the chain stitch, 2 is an elastic yarn to be inserted in a lengthwise direction into this chain stitch and 3 is a non-stretch yarn to be inserted thereinto in a widthwise direction. In this example, the non-stretch yarn 3 in the widthwise direction is inserted in such a manner that its oblique direction is changed every three stitches of the chain stitch. FIG. 2 is another example of the fabric substrate of the present invention in which "a" is the lapping movements of the fabric substrate and "b" is a drawing of the structure of the knitted fabric. FIG. 2 has the same knitted structure as FIG. 1 except for the knitted loop of the chain stitch. In other words, the closed loop is used for the chain stitch in FIG. 1, on the contrary the open loop is being used for the chain stitch in FIG. 2. FIG. 3 is another example of the fabric substrate of the present invention in which "a" is the lapping movements of the fabric substrate and "b" is a drawing of the structure of the knitted fabric. 21 is a stretch multifilament textured yarn forming the chain stitch, 22 is an elastic yarn inserted in a lengthwise direction into this chain stitch and 23 is a non-stretch yarn inserted thereinto in a widthwise direction. In this example, the non-stretch yarn 23 in the widthwise direction is inserted in such a manner that the directions of stitches of the chain stitch are successively changed. FIG. 4 is a diagram of an example of the stretch multifilament textured yarn used in the present invention. In the drawing, 31 is a stretch multifilament textured yarn and is formed by bundling of plural filaments 32 each of which is subjected to a stretching treatment. FIG. 5 is another example of the stretch multifilament textured yarn used in the present invention. In the example of this drawing, plural filaments 32 are connected at the connecting point 33 having a length of L at a distance of D to form a stretch multifilament textured yarn 34.

The cases where the fabric substrate of the present invention is used for a water curable cast which is used with an object of protection, supporting and fixation of the diseases part in an orthopaedic field will be illustrated in the Examples as hereunder.

EXAMPLE 1

Two multifilament yarns having a linear density of 167 dtex each yarn constituted from polyester filament which was subjected to a stretching treatment using a heat texturing process of knit-de-knit were aligned and connected at connecting times of 2 times/cm where length of each connecting point was made 7.5 mm. The resulting multifilament textured yarn was used as a warp to chain-stitch and a polyurethane elastic yarn having a linear density of 320 dtex was used as a warp and inserted in a lengthwise direction while polyester non-stretch yarns having a linear density of 1100 dtex were aligned was inserted as a weft in a widthwise direction to prepare a fabric substrate having the mass per unit area of 184 g/m$^2$, the thickness of 1.7 mm and with gauge E10 of the knitting machine.

EXAMPLE 2

Two multifilament yarns having a linear density of 167 dtex each yarn constituted from polyester filament which was subjected to a stretching treatment using a heat texturing process of knit-de-knit were aligned and connected at connecting times of 2 times/cm where length of each connecting point was made 7.5 mm. The resulting multifilament textured yarn was used as a warp to chain-stitch and a polyurethane elastic yarn having a linear density of 320 dtex was used as a warp and inserted in a lengthwise direction while a polypropylene non-stretch yarn having a linear density of 1100 dtex were aligned and inserted as a weft in a widthwise direction to prepare a fabric substrate having the mass per unit area of 138 g/m$^2$, the thickness of 1.3 mm and with gauge E10 of the knitting machine.

EXAMPLE 3

Two multifilament yarns having a linear density of 167 dtex each yarn constituted from polyester filament which was subjected to a stretching treatment using a heat texturing process of knit-de-knit were aligned and connected at connecting times of 2 times/cm where length of each connecting point was made 7.5 mm. The resulting multifilament textured yarn was used as a warp to chain-stitch and a polyurethane elastic yarn having a linear density of 320 dtex was used as a warp and inserted in a lengthwise direction while a polypropylene non-stretch yarn having a linear density of 1100 dtex were aligned was inserted as a weft in a widthwise direction to prepare a fabric substrate having the mass per unit area of 104 g/m$^2$, the thickness of 1.1 mm and with gauge E7.5 of the knitting machine.

EXAMPLE 4

Two multifilament yarns having a linear density of 167 dtex each yarn constituted from polyester filament which was subjected to a stretching treatment using a heat texturing process of knit-de-knit were aligned and connected at connecting times of 2 times/cm where length of each connecting point was made 7.5 mm. The resulting multifilament textured yarn was used as a warp to chain-stitch and a polyurethane elastic yarn having a linear density of 320 dtex was used as a warp and inserted into this chain stitch structure in a lengthwise direction while polyester non-stretch yarns having a linear density of 1100 dtex were aligned was inserted as a weft in a widthwise direction to prepare a fabric substrate having the mass per unit area of 139 g/m$^2$, the thickness of 1.1 mm and with gauge E7.5 of the knitting machine.

EXAMPLE 5

Two multifilament yarns having a linear density of 167 dtex each yarn constituted from polyester filament which was subjected to a stretching treatment using a heat texturing process of knit-de-knit were aligned and connected at connecting times of 2 times/cm where length of each connecting point was made 7.5 mm. The resulting multifilament textured yarn was used as a warp to chain-stitch and a polyurethane elastic yarn having a linear density of 320 dtex was used as a warp and inserted into this chain stitch structure in a lengthwise direction while polyester non-stretch yarns having a linear density of 1100 dtex were aligned was inserted as a weft in a widthwise direction to prepare a fabric substrate having the mass per unit area of 174 g/m$^2$, the thickness of 1.3 mm and with gauge E9 of the knitting machine.

EXAMPLE 6

Two multifilament yarns having a linear density of 167 dtex each yarn constituted from polyester filament which was subjected to a stretching treatment using a heat texturing process of knit-de-knit were aligned and connected at connecting times of 2 times/cm where length of each connecting point was made 7.5 mm. The resulting multifilament textured yarn was used as a warp to chain-stitch and a polyurethane elastic yarn having a linear density of 320 dtex was used as a warp and inserted into this chain stitch structure in a lengthwise direction while polypropylene non-stretch yarns each having a linear density of 1100 dtex were aligned was inserted as a weft in a widthwise direction to prepare a fabric substrate having the mass per unit area of 139 g/m$^2$, the thickness of 1.5 mm and with gauge E9 of the knitting machine.

In order to compare with the examples of the present invention, a fabric substrate for a water curable cast which has been conventionally used with an object of splint mainly for bone fracture, dislocation, etc. in the same orthopaedic field will be shown as hereunder as a Comparative Example.

COMPARATIVE EXAMPLE

A double yarn comprising of two twisted polyester filaments each having a linear density of 167 dtex was subjected to a chain stitching using a stretch yarn where twist was fixed by a heating treatment as a warp and four polyester non-stretch yarns each having a linear density of 278 dtex were aligned was inserted in a widthwise direction as a weft to prepare a fabric substrate having the mass per unit area of 186 g/m$^2$, the thickness of 1.1 mm and with gauge E10 of the knitting machine.

The fabric substrates in the above examples and Comparative Example were tested for elongation percentage, compressive strength, sensory test and reactivity test with water curable resin.

Elongation Percentage:

A fabric substrate was cut in a rectangle having a size of 20 cm and 12.5 cm in lengthwise and widthwise directions, respectively. Then, two sheets of release paper coated with a water curable polyurethane resin in a thickness of 32 μm were prepared and the cut fabric substrate was inserted between the coated release paper sheets and allowed to stand for 2 minutes. After that, the release paper sheets were removed and the fabric substrate into which the resin was impregnated was placed in a bag made of laminated aluminum film and tightly sealed in such a state that inner air was substituted with nitrogen. That was stored under the condition of 20° C. temperature and 20% relative humidity for 24 hours to prepare a specimen for the measurement. After that, the specimen was taken out from the bag made of laminated aluminum film under an atmosphere of 23° C. temperature and 25% relative humidity and subjected to the measurement of elongation percentage using a constant rate of extension tensile testing machine with an automatic record device (manufactured by Instron Corporation). The measuring condition was that the specimen was placed so as to make the length of specimen between clamps 100 mm, a load-elongation curve was drawn under a tensile speed of 1,000 mm/minute and, from the curve, the elongation percentage when loaded with 9.81 N was calculated using the following formula.

$$\text{Elongation Percentage (\%)}=(L1/L0)\times 100$$

In the formula, L1 is length of the specimen between clamps after extension and L0 is the original length of the specimen between clamps in the initial stage (100 mm).

Compressive Strength:

A fabric substrate was cut in a rectangle having a size of 60 cm and 12.5 cm in lengthwise and widthwise directions, respectively and a specimen as prepared under the same procedure and condition as same as in the case of the above-mentioned elongation percentage measurement. After that, the specimen was taken out from a bag made of laminated aluminum film under the condition of 23° C. temperature and 25% relatively humidity, dipped in distilled water of 20° C. for 5 to 10 seconds, taken out from water and squeezed by both hands to such an extent that no more water was dropped. The specimen was wound round in three layers without tension on a cylindrical vessel having a diameter of 60 mm previously equipped with a tubular bandage (Whitenet™; manufactured by Alcare Co., Ltd.) to form a cylindrical shape. After 5 minutes, the specimen was taken out from the cylindrical vessel so as not to be deformed and preserved for 24 hours in a constant temperature oven of 20° C. (manufactured by Yamato Scientific Co., Ltd.). After the preservation, the specimen set in a non-loaded state between two disk-shaped jigs was compressed at a test speed of 25 mm/minute in a radial direction using an Autograph AG-D (a precise multi-purpose tester by a computer-aided measurement; manufactured by Shimadzu Corporation), the stress until a deformation of 5 mm was resulted was measured and that was defined as a compressive strength.

Sensory Test:

A specimen was prepared by the procedures and conditions as same as for those used in the above-mentioned measurement for compressive strength. After that, the specimen was taken out from the bag made of laminated aluminum film, dipped in distilled water of 20° C. for 5 to 10 seconds, taken out from water and squeezed by both hands to such an extent that no more water dropped. The specimen was wound round a human forearm previously covered by a tubular bandage (Whitenet™; manufactured by Alcre Co., Ltd.). Further, on the cast specimen, the surface was rubbed so that the fabric substrate fits the shape of the human forearm. Then degree of easiness of winding of the fabric substrate and fitting property (follow-up property to the applied site and loosening after winding) at that time were sensuously evaluated as compared with Comparative Example. Criteria for the evaluation were in three grades in which A was the case where easier winding and better fitting property than Comparative Example were noted, B was the case where the same winding and fitting as in Comparative Example were noted and C was the case where the result was inferior to Comparative Example.

Reactivity Test with Water Curable Resin:

A fabric substrate was cut in a rectangle having a size of 10 cm and 12. 5 cm in lengthwise and widthwise directions, respectively and placed together with 100 g of a water curable polyurethane resin in a glass bottle which was able to be tightly sealed and the inner air was substituted with nitrogen. This glass bottle was preserved in a constant temperature oven of 40° C. (manufactured by Yamato Scientific Co., Ltd.) and the period until the resin began to cure was checked. That was carried out by naked eye after 1 day, 3 days, 1 week, 2 weeks, 3 weeks, 1 month and 2 months from the preservation.

Results of the above-mentioned tests are shown in the following table.

| | Elongation Percentage (at 9.81N) | | | | Reactivity Test with Water Curable Resin (○: not cured; x; cured) | | | | | | |
|---|---|---|---|---|---|---|---|---|---|---|---|
| | Fabric Substrate | After Coated with Resin | Compressive Strength (N/mm) | Sensory Test | 1 D | 3 D | 1 W | 2 W | 3 W | 1 M | 2 M |
| Ex. 1 | 143% | 136% | 0.42 | B | ○ | ○ | ○ | ○ | ○ | ○ | ○ |
| Ex. 2 | 153% | 136% | 0.27 | A | ○ | ○ | ○ | ○ | ○ | ○ | ○ |
| Ex. 3 | 148% | 136% | 0.17 | B | ○ | ○ | ○ | ○ | ○ | ○ | ○ |
| Ex. 4 | 143% | 134% | 0.29 | B | ○ | ○ | ○ | ○ | ○ | ○ | ○ |
| Ex. 5 | 154% | 140% | 0.37 | A | ○ | ○ | ○ | ○ | ○ | ○ | ○ |

-continued

| | Elongation Percentage (at 9.81N) | | | | Reactivity Test | | | | | | |
|---|---|---|---|---|---|---|---|---|---|---|---|
| | Fabric | After Coated | Compressive Strength | Sensory | with Water Curable Resin (○: not cured; x; cured) | | | | | | |
| | Substrate | with Resin | (N/mm) | Test | 1 D | 3 D | 1 W | 2 W | 3 W | 1 M | 2 M |
| Ex. 6 | 173% | 149% | 0.31 | A | ○ | ○ | ○ | ○ | ○ | ○ | ○ |
| Comp Ex. | 180% | 170% | 0.46 | — | ○ | ○ | ○ | ○ | ○ | ○ | ○ |

As will be apparent from the table, the fabric substrate of the present invention has the following properties.

(1) With regard to elongation percentage, it satisfied the elongation percentage range of 110~170% which was sufficient for fitting the shape of the site to be applied and was able to apply an appropriate compression.

(2) With regard to the compressive strength, Examples 1, 5 and 6 showed the same or a little lower values as compared with Comparative Example and the strength had no problem in using with the same object (fixation of bone fracture, dislocation, etc.) as the Comparative Example. Examples 2, 3 and 4 had no sufficient strength for a strong fixation for bone fracture, dislocation, etc. although it was still applicable as a material for protection and support depending upon the state of the diseased part and other physical properties such as elongation and fitness had no problem.

(3) With regard to easiness of winding of the fabric substrate and fitting property (fitting property to human body and loosening after being wound), the evaluation was same as or better than the conventional one.

(4) In the reactivity test with a water curable resin, it was confirmed that the water curable resin did not cure during the test, there was no bad-effect on the resin by the fabric substrate and the product was stable with a lapse of time.

In the above Examples, there were mentioned the fabric substrates which were used particularly for a water curable cast although it is also possible to apply the same constitution for a fabric substrate used as a covering material for bandage for compression and fixation, adhesive tape, coating material for therapy and covering material for medical devices which are the object of the present invention.

In accordance with the present invention, the fundamental structure of a fabric substrate is formed by a chain stitch and, since the chain stitch is a knitted structure which is simple and has a high productivity, the fabric substrate can be manufactured at a low cost. In addition, the fabric substrate of the present invention has a good elastic recovery of elongation, shows no decrease in width in the widthwise direction upon elongation in a necessary amount in the lengthwise direction and does not loosen even after winding the diseased part but well fits the applied area. When a water curable resin is used, it is possible to give a water curable cast where breakage of yarn hardly takes place, deviations in thickness and physical properties are little and properties are stable. With regard to a bandage for compression and fixation, it has appropriate stretch and elastic recovery of elongation and, therefore, it is easily wound round the diseases part giving a preferred compression and results in a uniform oppression due to little deformation in the widthwise direction of the fabric substrate. When the construction is made by plural filaments prepared by a stretching treatment of multifilament textured yarn, an appropriate frictional resistance is achieved when the fabric substrates are used by layering and slippage upon application to the diseased part hardly takes place. In the case of an adhesive tape, it is apt to fit the diseased part due to appropriate stretch and elastic recovery of elongation and, when it is constituted from plural filaments prepared by a stretch treatment of multifilament textured yarn, a let-go-anchor property of the adhesive to the fabric substrate is good and residue of the adhesive is hardly formed. In the case of a coating material for the therapy, it is apt to fit the diseased part due to appropriate stretch and elastic recovery of elongation and, when it is constituted from plural filaments prepared by a stretch treatment of multifilament textured yarn, impregnation of the effective ingredient into the fabric substrate is good. In the case of a covering material, it has an appropriate stretch and, therefore, it is apt to fit the applied site together with a sufficient achievement of the medical device to be coated. When it is constituted from plural filaments prepared by a stretch treatment of multifilament textured yarn, the space among the filaments effectively acts and shows excellent perspiration and heat insulation when applied to human body.

The invention claimed is:

1. A stretch fabric substrate for medical use, comprising the substrate being warp knitted and formed by means of a chain stitch using a stretch multifilament textured yarn; elastic yarns and non-stretch yarns are inserted in the lengthwise direction and in the widthwise direction respectively to the chain stitch; the multifilament textured yarn is constituted by alignment of plural filaments which are subjected to stretch treatments, and at least a proportion of the filaments are connected to one another at connecting points at intervals in the lengthwise direction of the filaments.

2. A stretch fabric substrate for medical use according to claim 1, wherein the elongation percentage of a 12.5 cm wide length of the fabric substrate in the lengthwise direction with a load of 9.81 N is 120% to 180%.

3. A curable bandage for fixation for orthopaedics comprising a stretch fabric substrate for medical use as claimed in claim 2, wherein a curable resin is coated on the stretch fabric substrate.

4. A stretch fabric substrate for medical use according to claim 1, wherein the multifilament textured yarn has an elongation caused by the structure of the filaments of 1.1 to 2.0-fold when loaded compared with the unloaded length.

5. A curable bandage for fixation for orthopaedics comprising a stretch fabric substrate for medical use as claimed in claim 4, wherein a curable resin is coated on the stretch fabric substrate.

6. A stretch fabric substrate for medical use according to claim 1, wherein the multifilament textured yarn is comprised of polyester resin, polyamide resin or polyolefin resin.

7. A curable bandage for fixation for orthopaedics comprising a stretch fabric substrate for medical use as claimed in claim 6, wherein a curable resin is coated on the stretch fabric substrate.

8. A stretch fabric substrate for medical use according to claim 1, wherein 50% or more of the filaments are connected to each other at each connecting point of the filaments in the multifilament textured yarn.

9. A curable bandage for fixation for orthopaedics comprising a stretch fabric substrate for medical use as claimed in claim 8, wherein a curable resin is coated on the stretch fabric substrate.

10. A stretch fabric substrate for medical use according to claim 1, wherein the length of each of the connecting points between the filaments in the multifilament textured yarn is 1 to 20 mm and excluding the length of the connecting points there are from 0.3 connecting points/cm to 10 connecting points/cm.

11. A curable bandage for fixation for orthopaedics comprising a stretch fabric substrate for medical use as claimed in claim 10, wherein a curable resin is coated on the stretch fabric substrate.

12. A curable bandage for fixation for orthopaedics comprising a stretch fabric substrate for medical use as claimed in claim 1, wherein a curable resin is coated on the stretch fabric substrate.

13. A curable bandage for fixation orthopaedics according to claim 12, wherein the curable resin has an isocyanate group at its terminal.

* * * * *